United States Patent [19]

Gross et al.

[11] 4,382,703

[45] May 10, 1983

[54] PRINT ELEMENT SHIFTER

[75] Inventors: Thomas D. Gross, Los Altos; Brian E. Jagger, Union City, both of Calif.

[73] Assignee: Xerox Corporation, Stamford, Conn.

[21] Appl. No.: 369,679

[22] Filed: Apr. 19, 1982

[51] Int. Cl.[3] ..... B41J 25/24; B41J 1/24

[52] U.S. Cl. ..... 400/257; 400/144.2

[58] Field of Search ..... 400/257, 144.2, 144.3, 400/144, 144.1, 256, 258, 261, 144.4, 142, 143

[56] References Cited

U.S. PATENT DOCUMENTS

| | | | |
|---|---|---|---|
| 3,651,915 | 3/1972 | Folkens | 400/144.3 |
| 3,651,916 | 3/1972 | Becchi | 400/144.3 |
| 3,921,787 | 11/1975 | Fujio et al. | 400/141.1 |
| 4,106,611 | 8/1978 | Suzuki et al. | 400/144.2 |
| 4,313,681 | 2/1982 | Lendl et al. | 400/144.2 |

FOREIGN PATENT DOCUMENTS

| | | | |
|---|---|---|---|
| 55-41213 | 3/1980 | Japan | 400/144.2 |
| 55-118868 | 9/1980 | Japan | 400/144.2 |

*Primary Examiner*—Edgar S. Burr
*Assistant Examiner*—Charles Pearson
*Attorney, Agent, or Firm*—Serge Abend

[57] ABSTRACT

An improved print element shifting apparatus having a shifting cam movable in an arc for moving a rotatable print element between two positions by means of a shifting solenoid, and for reducing the mid-stroke peak load on the solenoid. A load modifying linkage arrangement is provided between the shifting solenoid and the shifting cam for imparting movement to the shifting cam alternatively from the one of two drive elements having the greatest mechanical advantage.

6 Claims, 4 Drawing Figures

CURVE B
CURVE D
CURVE A
CURVE C
SOLENOID PULL FORCE
STROKE

PRINT ELEMENT SHIFTER

This invention is an improvement over the print element shifter disclosed in our copending patent application assigned to the same assignee, entitled "Print Element Shifter" (Gross et al), filed on Sept. 17, 1981, and bearing Ser. No. 6-303,291. The shifter described in these applications is designed for use in an impact printer, having a print element bearing characters on two circular rows thereof. It is designed to move the print element rapidly and accurately from a first operational position, wherein a printer hammer is aligned with the print characters of one circular row to a second operational position, wherein the printer hammer is aligned with the second circular row of characters. The improvement herein comprises a linkage arrangement to be used with the shifter of our earlier filed application, for more evenly distributing the load on the shifting solenoid during its stroke and, more particularly, for reducing the high load force usually seen by that solenoid at the mid-point of its stroke.

In recent years, serial impact printers utilizing print elements such as "daisy" wheels or "thimbles" have had increasing popularity. The "daisy" wheel comprises a rotary hub from which plural radial spokes or "petals" extend, with each spoke carrying at its end a character pad bearing the impression of a character in relief. The "thimble" is a cup-shaped print element with characters carried around its lip. It may be considered to be a daisy wheel with its spokes bent substantially at right angles. Each print element bears a number of characters including letters, numerals and symbols designed in accordance with a font motif. Printing is accomplished, with both of these types of elements, by mounting the hub of each upon a rotary drive shaft extending from a drive motor indexable by means of suitable control logic to align the desired charcter in front of the hammer. As both of these print elements are light and compact, they have relatively low inertia, enabling rapid rotation during the printing sequence. This enables high speed printing. Because installation and removal of the print elements of these printers are generally mechanically simple maneuvers, the user is afforded great flexibility in selecting and changing type styles, since, in order to change a given font the user merely replaces the element then in the machine with another element.

It has become desirable, in many instances, to increase the number of characters carried by a given print element. Clearly, one method of accommodating a greater number of characters is by adding more spokes. This will increase the capacity of the element but it will also increase the diameter of the wheel, resulting in an increase in the inertia of the element. Ultimately, as the print element becomes too large, the speed of operation of the printer, during its normal operation, would have to be reduced. A logical alternative to increasing the size of the print element is to increase the number of characters on an element of a given size. This may be accomplished by placing more than one circle of characters on the element, i.e. inner and outer concentric circles of characters on a "daisy" wheel, or upper and lower circles of characters on a "thimble". With print elements of this type, a greater character capacity is achieved without substantially increasing the inertia of the element.

In each of U.S. Pat. Nos. 3,651,915 ("Printing Mechanism For Electrically Operated Office Machines", Folkens), 3,651,916 ("Printing Device With Interchangeable Printing Members", Becchi), 3,921,787 ("High Speed Type Positioning Mechanism", Fujio et al) and 4,106,611 ("Serial Printing Apparatus", Suzuki et al) there is shown a print element having two circles of characters, in the form of a printwheel. Furthermore, in each of U.S. Pat. Nos. 3,651,916 and 4,106,611 there is also disclosed a "thimble"-type print element with two circles of characters. In each of these patents, in order to position the selected character to be printed in front of the print hammer, it is necessary to provide some suitable mechanism for repositioning the print element. Thus, in U.S. Pat. No. 3,651,915 the printwheel is secured to and is moved vertically by means of a carrying member lifted and lowered on movable rods. In U.S. Pat. No. 3,651,916 the axial drive shaft of the illustrated printwheel is supported by an arm movable in an arc and the axial drive shaft of the illustrated "thimble" may be moved axially by a positioning electromagnet. In U.S. Pat. No. 3,921,787 the printwheel is shifted by a pivoting motor driven arm acting on the printwheel support shaft. Also, in U.S. Pat. No. 4,106,611 the illustrated printwheel is shifted by a crank arm drawn into each its upward and downward positions by shifting solenoids, and the illustrated "thimble" (shown with four circles of characters) is vertically slidable on its axis.

We have found that a major factor controlling the speed of printing, in these dual circle print element devices, is the settling delay time after shifting during which the print element continues to vibrate as it settles into its "home" position. Such a delay is inherent in mechanical linkage systems wherein drivers move connecting links against fixed stops. In the system disclosed in U.S. Pat. No. 4,106,611, where the crank arm is slammed against the shifting solenoids there is a tendency for the crank arm, and the print element intimately connected thereto, to bounce and vibrate before it actually settles into its home position. Similarly, in the other patents referred to above, it also appears that extended settling will be encountered. If printing is effected too soon after shifting, while the print element is vibrating, the printed characters of the alternate circle will not lie upon the typed base line and will render the printed page unappealing. Furthermore, by using these dual circle print element devices, composite characters may be constructed by combining character elements residing on different spokes. Clearly, extremely good registration is required when this procedure is accomplished. Any residual vibrations in the print element, during the construction of characters, will result in poor character rendition.

It is the intent of this invention to provide a shifting mechanism which will move a dual character circle print element, accurately and at a high rate of speed, from one character circle to another while eliminating the heretofore encountered problem of vibration at its home position. Smooth, rapid and accurate shifting is accomplished by means of an arcuately movable crank arm connectable to the print element through a shifting cam. A drive pin on the crank arm is captured in a slot formed in the shifting cam such that there is driving contact between the crank arm and the shifting cam between two end of travel positions defined by tapered end walls of the slot. A load leveling linkage arrangement is interposed between the driving solenoid plunger and the crank arm for eliminating high peak forces which are normaly encountered as the driving load increases to a maximum value at mid-stroke.

This invention may be carried out, in one form, in accordance with the following detailed description and with reference to the drawings, in which.

Figures 1, 3:
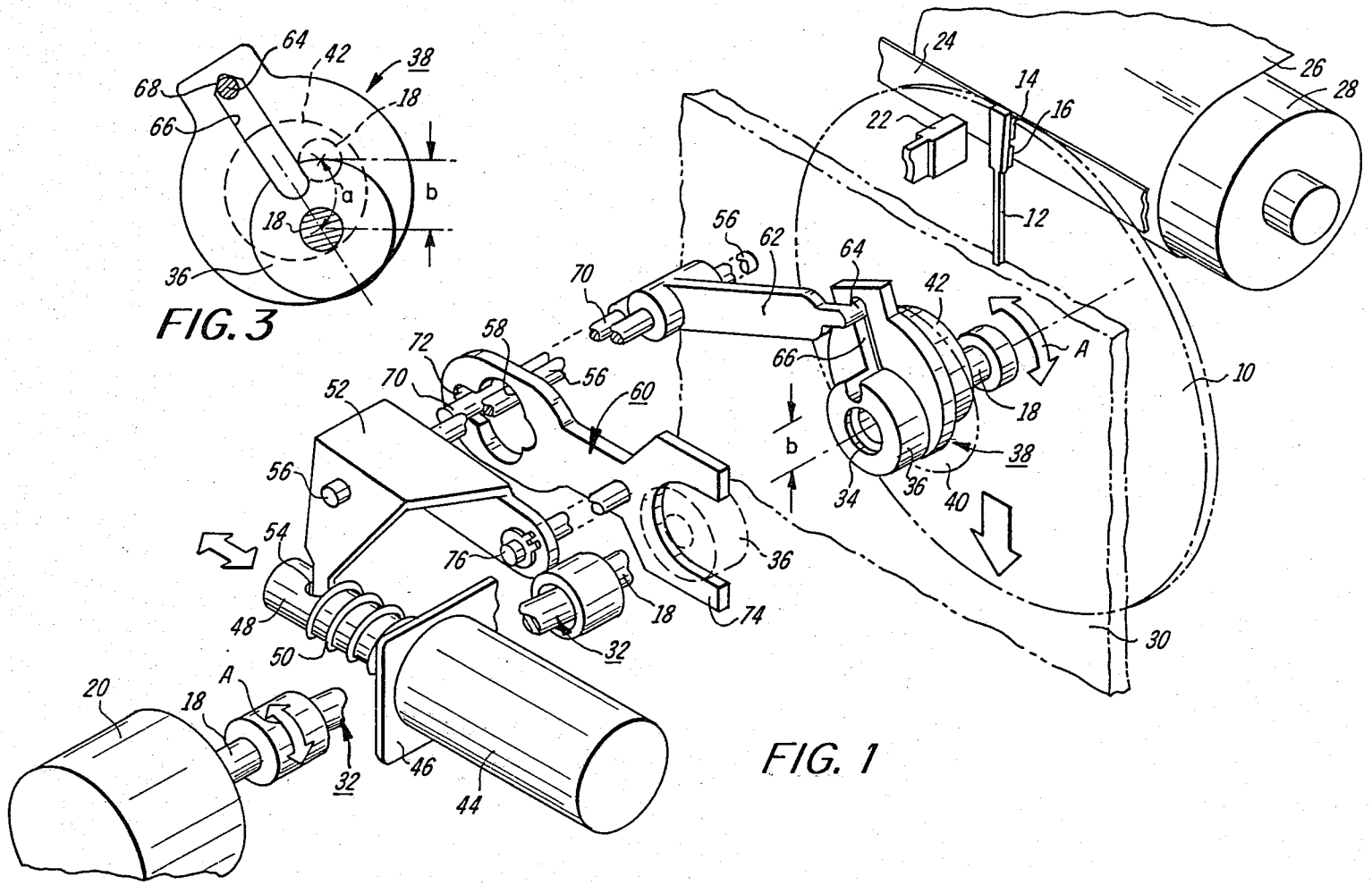
FIG. 1 is a perspective view of the improved print element shifter, showing the relationship of parts when the print element is in its lowered position for addressing characters upon its outer concentric circle.
FIG. 3 is a detail view of the shifter cam, showing the crankpin guiding slot with its tapered end walls.

With particular reference to the drawings, there is shown in FIG. 1 a printwheel 10 provided with radial spokes, of which element 12 is typical. Each spoke 12 is provided with an outer character 14 and an inner character 16 such that the printwheel has two concentric circles of characters. The printwheel is removably mounted on drive shaft 18 which is rotatable either in a clockwise or a counterclockwise direction, as represented by arrow A, under the motive force of printwheel motor 20. In this manner, the proper angularly oriented spoke may be aligned with and arrested in front of hammer 22. A hammer, such as that disclosed and fully described in U.S. Pat. No. 4,037,532 entitled "Hammer Assembly" and assigned to the same assignee as the instant application, may be advantageously used herein. Properly timed energization of the hammer 22 will impact the selected character and move it against inked ribbon 24 and record receiving sheet 26 supported by platen 28. Thus, ink will be released from the ribbon 24 and transferred to the sheet in the shape of the impacted character.

Printwheel driving elements, ribbon driving elements and the hammer driving elements are supported upon the usual movable carriage for reciprocation parallel to the axis of platen 28. A single wall 30 of the known carriage is shown.

The driveshaft 18 extending from the printwheel 10 to its motor 20 includes a double universal flexible coupling 32 which allows the printwheel to be shifted in space, in a direction perpendicular to its axis, while still being positively driven by the motor 20. A configuration of such a coupling which we have designed to eliminate backlash is the subject of our copending application Ser. No. 369,779 filed concurrently herewith and entitled "Anti-Backlash Double Universal Flexible Coupling". Printwheel drive shaft 18, passes through and is suitably journalled for rotation in an eccentric bore 34 in eccentric boss 36 of shifter cam 38. The shifter cam itself is rotatably secured in carriage wall 30, within a bearing whose outer race 40 (shown in phantom line) is fixed within the wall 30 and whose inner race is mounted upon a central boss 42 on the shifter cam. Thus, the rotating drive shaft 18, passing through eccentric bore 34 in central boss 42 (as seen in FIG. 3), may be moved in an arcuate path from its lowered position to its raised position.

Movement of the shifter cam 38 is effected by a linkage arrangement driven by drive solenoid 44 fixed to carriage wall 30 by support plate 46. A solenoid drive plunger 48, normally biased outwardly by compression spring 50, captures one end of bell crank 52 within retaining opening 54. Bell crank pivot pin 56, is fixed at one end in carriage wall 30, passes through enlarged opening 58 in double slider 60 and provides the pivot axis for drive crank 62. At one end, the drive crank 62 supports a cam drive pin 64 which drives shifter cam 38 as it rides in slot 66. It should be noted, that the slot 66 terminates in a tapered portion 68 (best seen in FIG. 3), for the purpose to be described. At its other end, the drive crank 62 supports a crank drive pin 70 which rides in slot 72 at one end of the double slider 60. At its other end, the double slider comprises a fork 74 which straddles eccentric boss 36. Printwheel shifting movement is effected through this linkage as the double slider 60 is driven up and down by double slider drive pin 76 secured to the bell crank 52, in a manner to be described.

Figure 2:
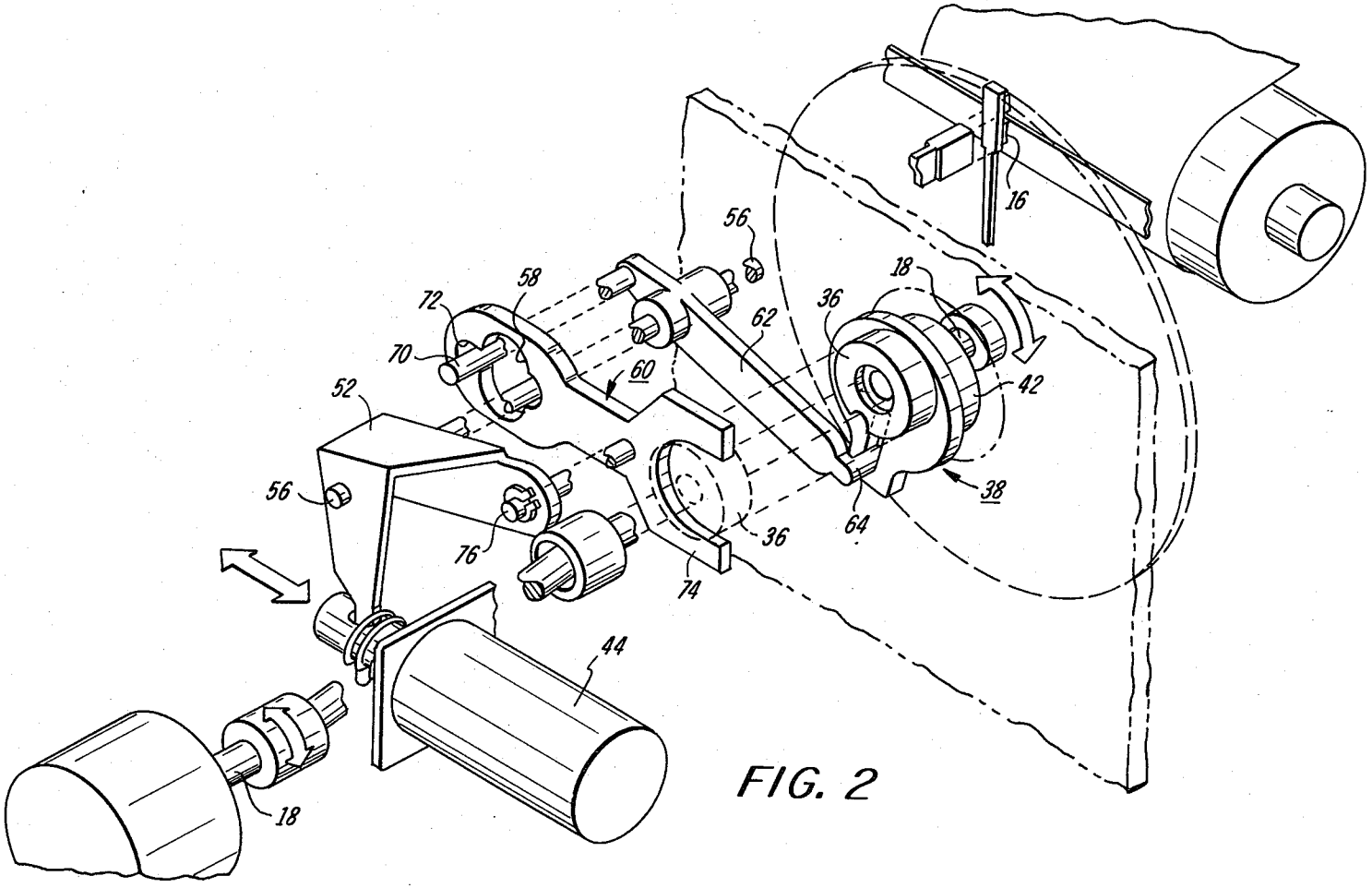
FIG. 2 is a perspective view of the improved print element shifter showing the relationship of parts when the print element is in its raised position for addressing characters upon its inner concentric circle.

In operation of the printer, the printwheel will be utilized for the great majority of its duty cycle in its normal position as illustrated in FIG. 1. In this manner, the outer concentric circle, on which the highly utilized characters reside, will be addressed. As it becomes necessary to address a character on the inner concentric circle, the improved printwheel shifting mechanism will move the printwheel from the position illustrated in FIG. 1 to that illustrated in FIG. 2. When it is no longer necessary to address characters on the inner concentric circle of characters, the printwheel will be moved back again to its normal position.

Figure 4:
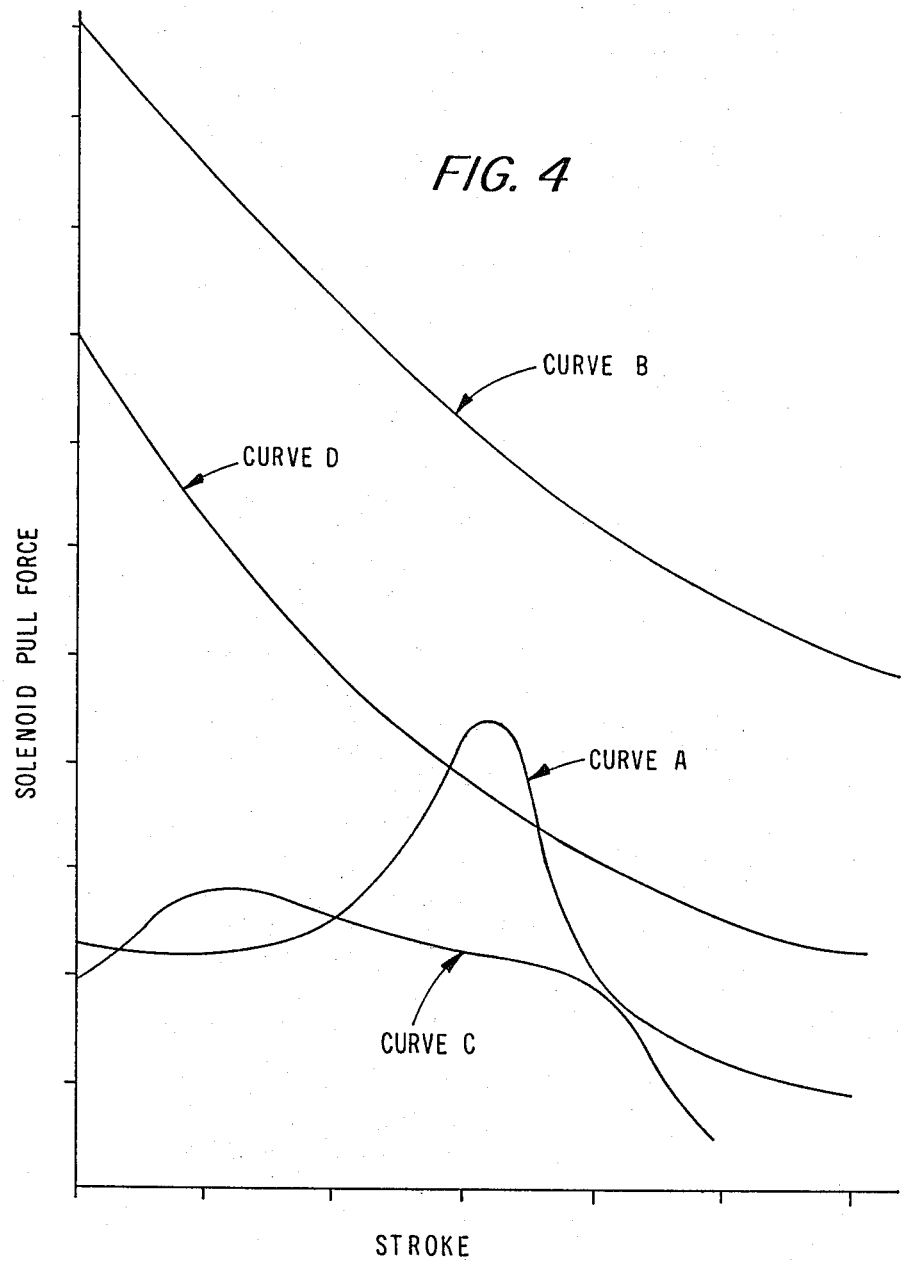
FIG. 4 is a graphical representation of the force versus stroke conditions seen by the driving solenoid.

In our copending application Ser. No. 6-303,291, referenced above, the shifter comprises a crank arm directly acted upon by a solenoid plunger. The resultant load upon the drive solenoid during its duty cycle is profiled as Curve A in FIG. 4, and comprises a high force near mid-stroke of the solenoid plunger. A solenoid of sufficient size and power to drive this load will produce output force as profiled in Curve B. Note that the force shown in Curve B covers the peak load at mid-stroke of Curve A. In our improved printwheel shifting mechanism, we have modified the printwheel linkage arrangement in order to lower the resultant peak load seen by the solenoid. This modified load is profiled in Curve C. As modified, the load profile enables the use of a smaller, lower power solenoid, whose lower drive force profile is depicted by Curve D. Use of a smaller drive solenoid provides the advantages of less mass on the printer's reciprocating carriage, allowing greater print speed, and lower electrical power consumption.

Shifting is accomplished as follows: Starting with the normal arrangement of parts, as illustrated in FIG. 1 and FIG. 3, the solenoid 44 will be energized to apply a pull-in force to the solenoid drive plunger 48. As this force is applied, the bell crank 52 will be rotated in a counterclockwise direction about pivot pin 56. The motive force is then transmitted to the double slider 60 by drive pin 76. At the start of the solenoid stroke, the fork 74 of the double slider 60, seated upon eccentric boss 36, is at a mechanical disadvantage because it is being urged to drive the eccentric boss over center. Therefore, the fork 74 will be initially arrested when the solenoid force is applied through the double slider drive pin 76. However, at the opposite end of the double slider 60, the crank drive pin 70 captured in slot 72 has a mechanical advantage at the start of the solenoid stroke. The mechanical advantage is achieved as the cam drive pin 64, at the opposite end of drive crank 62, starts moving easily within cam slot 66. Thus, the drive crank 62 begins to rotate in a clockwise direction about bell crank pivot pin 56 and starts the shifter cam 38 to rotate in a counterclockwise direction about its pivot axis as defined by its central boss 42.

As the shifter cam 38 approaches its mid-stroke position, the moment arm of the crank drive pin 70, relative to the shifter cam, becomes very small, increasing the work to be performed by the drive crank 62 and causing the slotted end 72 of the double slider 60 to be at a mechanical disadvantage. At the same time, the previous mechanical disadvantage of the fork 74 of the double slider is reversed and the eccentric boss 36 is easily driven over center by the solenoid force being applied to the slider pin 76.

As the drive crank 62 approaches the end of stroke position, there will be a final reversal of mechanical advantages relative to the ends of double slider 60. The fork 74 will again be arrested, and crank drive pin 70, acting upon drive crank 62 will urge cam drive pin 64 "home" within slot 66, to the position shown in FIG. 2. In this position, the printwheel driveshaft 16 will have traversed an arc "a" (best illustrated in FIG. 3) and be relocated directly above its normal position by a distance "d", so that the inner character 16 may be addressed by the hammer 20.

This sequence of movements, involving reversals of mechanical advantage, will be repeated in an opposite sense as the drive solenoid 44 is deenergized and the compression spring 50 returns the printwheel 10 to its lower position. As a result of the reversals of mechanical advantage throughout the solenoid stroke, the peak force requirements are reduced, as illustrated in Curve C of FIG. 4.

Movement of the shifting mechanism has been described insofar as it moves the printwheel rapidly, and with minimal force, to a vertically displaced position for addressing the selected circle of characters. Consideration of the detail illustrated in FIG. 3 will make clear the advantage achieved by the tapered end 68 of shifter cam slot 66. Rather than driving the drive crank 62 against fixed external stops at the upper and lower "home" positions, the cam drive pin 64 will be simultaneously halted and positively locates the tapered end 68. This will also positively lock the shifter cam 38 and prevent it from any slight wandering, resulting in positive positioning of the printwheel.

Although this invention has been illustrated with a printwheel, it should be apparent that suitable mechanical modifications may be made to allow the principle of isolated shifting to be used with a "thimble"-type print element. Furthermore, it should also be understood that the present disclosure has been made only by way of example, and that numerous changes in details of construction and the combination and arrangement of parts may be resorted to without departing from the true spirit and the scope of the invention as hereinafter claimed.

What is claimed is:

1. A print element shifting apparatus for moving a print element, provided with two circles of characters, between two operating positions, such that in one operating position the characters on one of the circles are in alignment with an impact element and in the other operating position the characters on the other circle are in alignment with the impact element, the apparatus characterized by including means for supporting said print element for rotation about its axis and for movement transverse to its axis between said two operating positions, rotating means for driving said support means, means for coupling said support means and said rotating means, shifting means movable between two end of travel positions and connected to said support means for moving said print element between said two operating positions, driving means for moving said shifting means, first and second drive elements each having a variable mechanical advantage, and means for driving said shifting means with the drive element having the greatest mechanical advantage including load modifying linkage means coupled between said shifting means and said driving means for imparting movement to said shifting means alternatively from one or the other of said first and second drive elements.

2. The print element shifting apparatus as defined in claim 1 characterized in that said shifting means comprises a cam centrally supported for rotation, said cam having a drive slot therein and an eccentric boss with an opening therethrough for receiving said support means, and said first drive element comprising a crank arm having a drive pin movable in said drive slot and said second drive element comprising a double slider arm having a forked end straddling said eccentric boss.

3. The print element shifting apparatus as defined in claim 2 characterized in that the end of said double slider arm opposite said forked end supports means for driving said crank arm and said driving means urges said double slider arm to move in an arc, whereby the end of said double slider arm having the greatest mechanical advantage will be moved and the end having the least mechanical advantage will act as a pivot.

4. The print element shifting apparatus as defined in claim 1, 2 or claim 3 characterized in that said driving means comprises a solenoid and said load modifying linkage means reduces the mid-stroke peak load thereon.

5. The print element shifting apparatus as defined in claim 2 characterized in that said shifting means is movable in an arc about said center of rotation and said drive slot is disposed in a radial direction relative to said center of rotation, and as said shifting means approaches said two end of travel positions said drive pin moves in said drive slot in a radial direction relative to said shifting means.

6. The print element shifting apparatus as defined in claim 2 or claim 5 characterized in that said drive slot has a closed tapered end for halting and positively locating said shifting means.

* * * * *